US006113314A

United States Patent [19]

Campbell

[11] Patent Number: 6,113,314

[45] Date of Patent: Sep. 5, 2000

[54] DISCONNECTABLE TENSION LEG PLATFORM FOR OFFSHORE OIL PRODUCTION FACILITY

[76] Inventor: Steven Campbell, 5 Mercer's Drive, St. John's, Newfoundland, Canada, A1A 3V3

[21] Appl. No.: 09/160,031

[22] Filed: Sep. 24, 1998

[51] Int. Cl.[7] ..... E02D 5/54; E21B 7/12

[52] U.S. Cl. ..... 405/224; 405/223.1; 405/195; 405/224.2; 166/339; 166/340; 166/352; 166/363

[58] Field of Search ..... 405/195, 200, 405/206, 207, 223.1, 224, 224.2; 166/339, 340, 352, 363, 365, 366; 285/1, 2, 3, 4, 25, 18, 26, 28, 29, 124.1; 137/68.14, 68.15, 236.1, 614.01, 614.5, 614.05; 114/230, 236; 441/4, 5

[56] References Cited

U.S. PATENT DOCUMENTS

| | | | |
|---|---|---|---|
| 3,955,521 | 5/1976 | Mott | 405/224 X |
| 3,982,401 | 9/1976 | Loggins | 405/207 |
| 4,035,092 | 7/1977 | Adams, Jr. | 403/2 |
| 4,321,720 | 3/1982 | Havre | 441/5 |
| 4,361,165 | 11/1982 | Flory | 137/614.02 X |
| 4,371,037 | 2/1983 | Arnaudeau | 166/366 |
| 4,392,513 | 7/1983 | Parrish | 137/614.01 |
| 4,604,961 | 8/1986 | Ortloff et al. | 114/230 |
| 4,614,201 | 9/1986 | King et al. | 137/68.14 |
| 4,895,481 | 1/1990 | Pepin-Lehalleur et al. | 405/224 |
| 5,292,207 | 3/1994 | Scott | 405/207 |
| 5,380,229 | 1/1995 | Korsgaard | 441/3 |
| 5,823,131 | 10/1998 | Boatman et al. | 114/230 |
| 5,823,837 | 10/1998 | Boatman et al. | 441/5 |

FOREIGN PATENT DOCUMENTS

| | | |
|---|---|---|
| 866577 | 3/1971 | Canada . |
| 1058978 | 7/1979 | Canada . |
| 1101830 | 5/1981 | Canada . |
| 1204945 | 5/1986 | Canada . |
| 1209815 | 8/1986 | Canada . |

*Primary Examiner*—David Bagnell
*Assistant Examiner*—Jong-Suk Lee

[57] ABSTRACT

A quick connect/disconnect system for an offshore oil/gas production platform is facilitated by a submerged connection header for the platform. The platform comprises a vessel with a connection bay on vessel bottom. The vessel has the ability to be ballasted to position the connection bay either for connection or for transport toward and away from the connection header. The connection header houses the production lines and control lines and is positively buoyed and held in place by tension cables extending from the header bottom to the ocean floor. The quick connect/disconnect system comprises couplers for the production lines and control lines and devices for releasably linking the header to the vessel bay whereby the vessel may be held in a state of positive buoyancy by appropriately deballasting the vessel. The quick connect/disconnect system includes a device for forcing apart the header from the vessel to break linking devices and coupling devices thereby permitting the vessel to move upwardly away from the connection header.

14 Claims, 10 Drawing Sheets

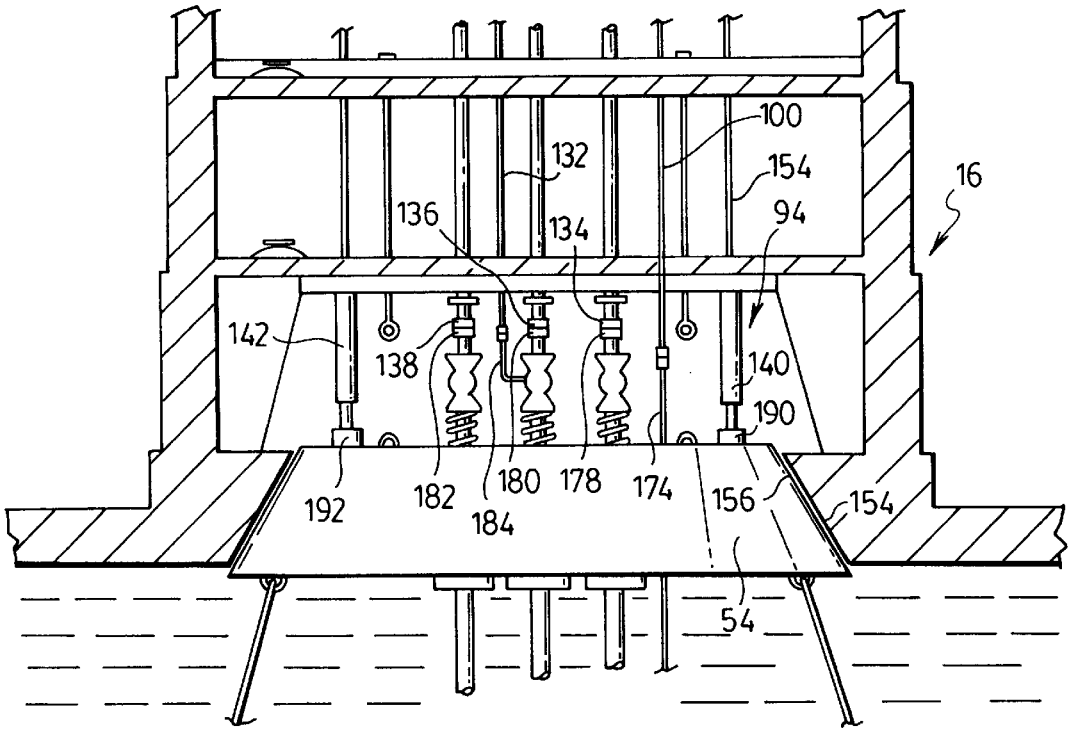
FIG. 9.
FIG. 10.
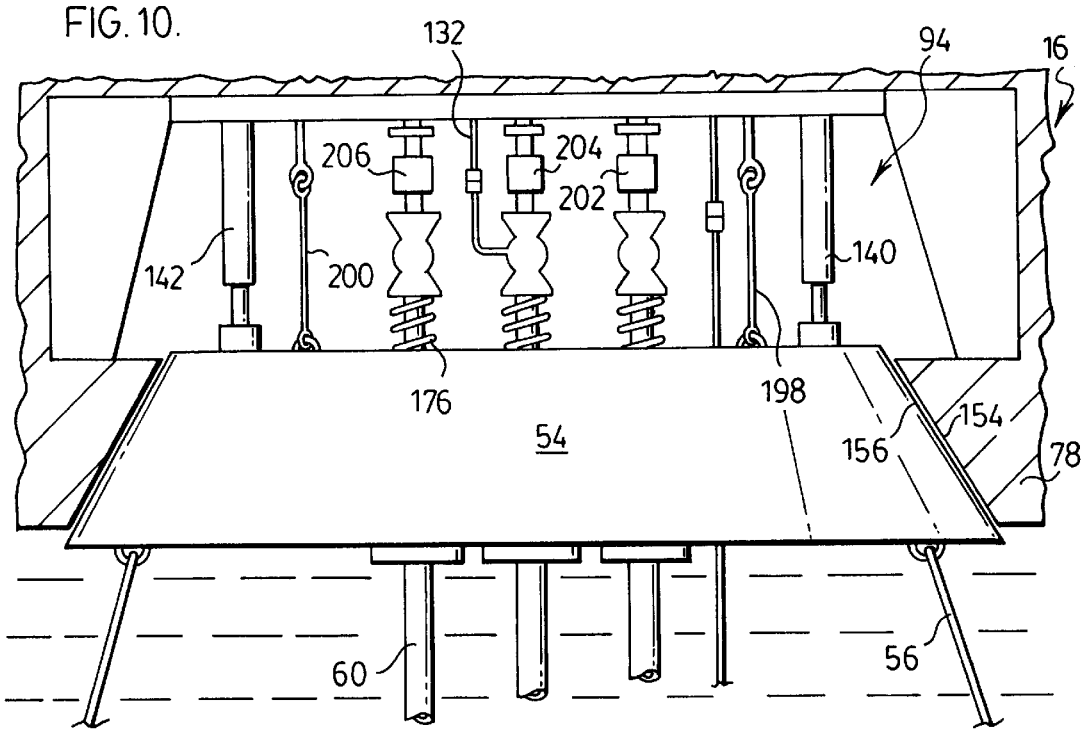

FIG.12.
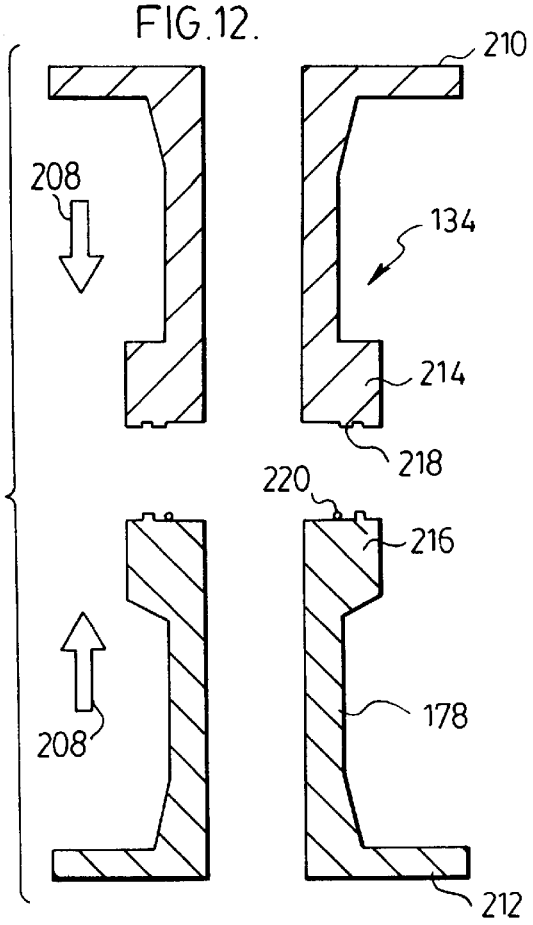
FIG.13.
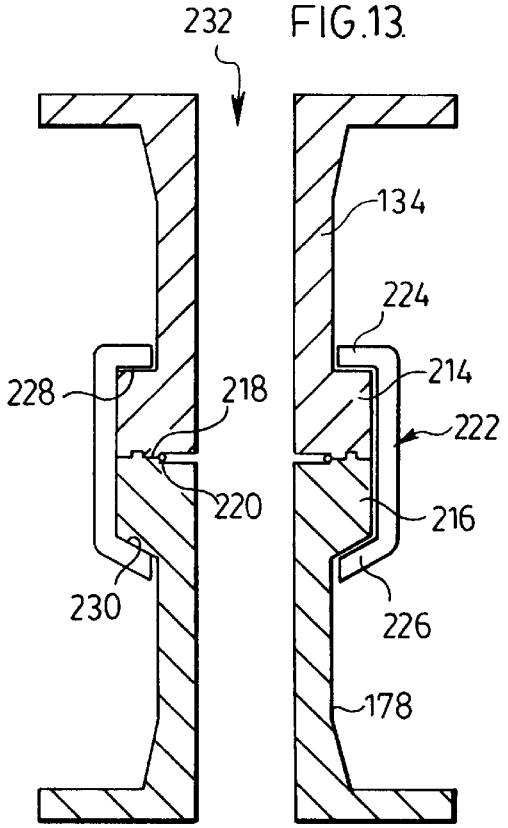
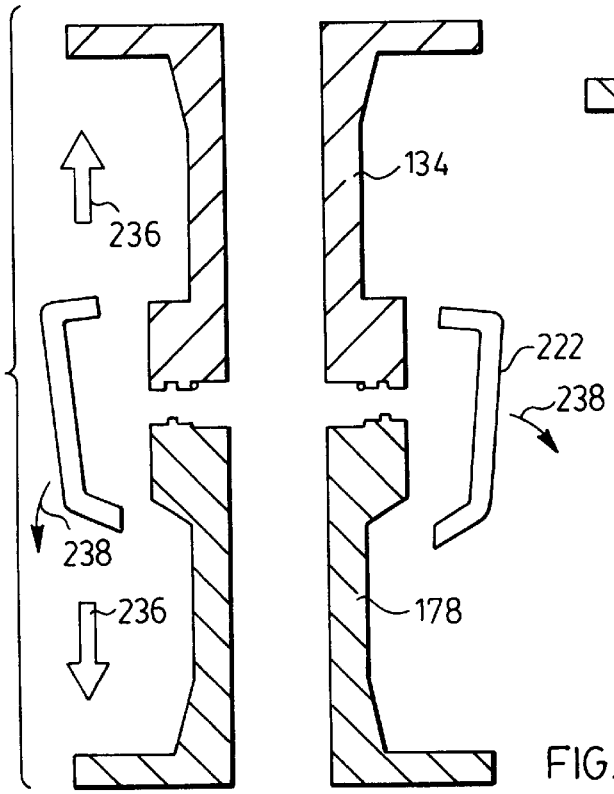
FIG.14.

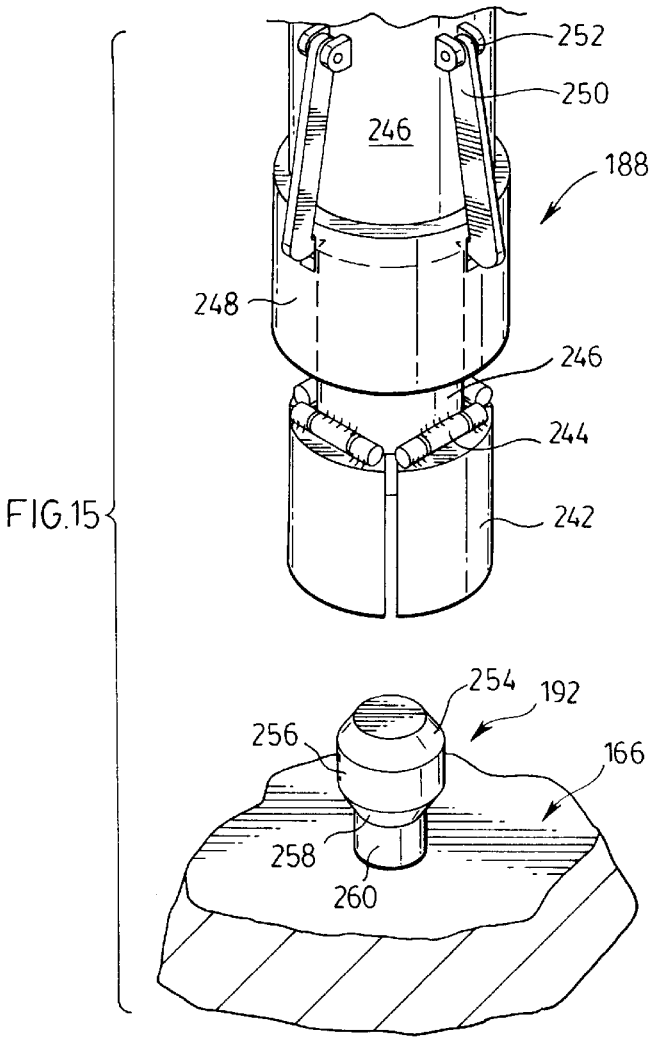
FIG.15
FIG.16.
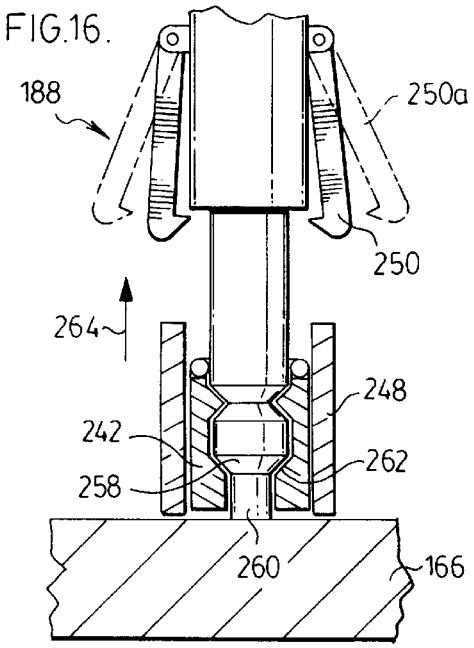
FIG.17.
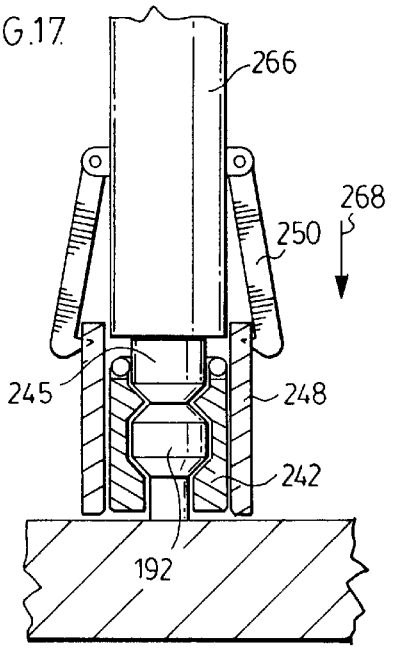

DISCONNECTABLE TENSION LEG PLATFORM FOR OFFSHORE OIL PRODUCTION FACILITY

FIELD OF THE INVENTION

This invention relates to an offshore oil/gas production platform with a quick connect/disconnect system to permit movement of the production vessel in the event of oncoming icebergs or other hazards.

BACKGROUND OF THE INVENTION

Offshore oil and gas production in temperate climates whether they be in shallow waters or deep waters can be achieved with production platforms which may be submerged caissons, semi-submersible vessels or tension cable position floatable vessels. However, in climates where icebergs, severe Arctic storms and the like may present hazards to the production vessel, the production platform designs for the temperate climates are not usable. An example of a semi-submersible system which is capable of withstanding icebergs, slab ice, packed ice and severe storm conditions is described in U.S. Pat. No. 5,292,207. The semi-submersible is capable of housing equipment which is ice crush sensitive or unable to withstand severe storms. The system is to some extent duplicite in that in addition to the semi-submersible vessel, drilling platforms and/or production platforms are also required.

Another approach to an offshore platform which resists icebergs is to install a gravity based structure which comprises a concrete monolithic caisson. This structure is intended to remain on the ocean floor and is constructed in a manner to resist icebergs by way of the provision of two concentric peripheral walls designed to withstand iceberg impact. This structure has to be of a substantial construction which is costly and is limited in respect of the depth of waters in which it may be installed.

Canadian Patent 1,209,815 describes a floatable gravity based structure which has an open centre to allow access to the well heads. Once the platform is connected to the foundation the central area is pumped out to allow dry access to the well heads. A negative hydrostatic force is used to restrain the platform on the bottom in preparation of disconnect. Once the equipment is disconnected from the well heads the semi-submersible may be deballasted to float away in the event of danger of collision with icebergs.

U.S. Pat. No. 3,982,401 describes a semi-submersible marine structure which is anchored by a buoyant substructure held in place by tension lines. The connection at the seabed provides for lateral movement of the marine structure due to wave action and wind forces. This structure may be used for either drilling or production, however the system does not readily lend itself to quick connect or disconnect. Deep-sea divers or submarines are required to attach the tension lines to the sea floor anchoring block.

U.S. Pat. No. 4,895,481 describes a floating platform which is connected to the seabed by the use of a flexible structure anchored to the seabed. The upper structure is buoyed by the use of floats which may be metal cylinders. The floats are located sufficiently deep to reduce the hydrodynamic forces induced by swell in the ocean. The floats are adjusted such that the forces exerted on the flexible structure and hence on the conducting tubes is greater than the total compressive force exerted on the conducting tubes of the drilling platform.

Canadian Patent 1,058,978 describes a quick release system for a tension leg offshore production platform. The system has to take away the tension in the tension lines in order to disconnect. There is no provision to ensure that a complete disconnection is made and there is no mention of how the production lines would be disconnected. The system is not designed to handle pack ice or small icebergs and the system does not have a device which would reduce buoyancy fluctuation caused by large waves. In addition hook-up would most likely require deep sea divers to complete the connections of production lines hence this system is useful solely in temperate climates.

Canadian patent 866,577 describes a production platform which is held in place by cables. The system according to one embodiment may include buoyant means on the riser pipe. The buoyant tanks 80 maintain tension in the riser pipe while connection is completed by way of reeling in lines 60 to position and lower the riser pipe into the proper position for connection to the well head. Again deep-sea divers would be required to complete the connection, thus, the system does not lend itself to a quick connect/disconnect.

Canadian patent 1,101,830 describes a disconnectable riser system which allows the drill string to stay in the hole and riser while the drill platform moves out of danger. This type of system is only for drilling in deep water. The riser itself is connected to the platform and is not held in tension. The riser system is buoyed to maintain the riser system in a substantially vertical disposition after being disconnected from the upper riser segment.

Canadian patent 1,204,945 discloses a fixed structure secured to a large subsea foundation. The fixed structure is like a gravity based structure when in operation mode. Stability is obtained by the structure being fixed to the bottom through direct contact with the foundation. The structure is only reusable in waters of the same depth and the foundation is not feasibly reusable. This structure has to be moved for all icebergs and most likely pack ice due to its design. Deep sea divers would be required to disconnect the risers and hence would take several hours to disconnect. At the time of disconnect the structure is held in a state of positive buoyancy where it is firmly seated on the sea bed foundation. The structure is maintained on the sea bed foundation by a hydrostatic force, although mechanical device may also be used. The structure, when connected by mechanical devices to the sub sea foundation, cannot resist any lateral forces because the mechanical connecting devices could be bent and become inoperable. In that event the entire structure would be rendered unmoveable and left in danger in the event of an approaching iceberg or storm. In the event of large sea swells of 15 meters or greater, for example, the structure may oscillate and plunge in a wave valley, striking the foundation on a downward oscillation. In these conditions a disconnect would almost be impossible.

In accordance with an object of an aspect of this invention an offshore oil/gas production platform is provided with a quick connect/disconnect system which involves the use of a submerged connection header. After connection is complete the production vessel is held in a state of positive buoyancy by way of the tension cables holding in turn the submerged connection header in a state of positive buoyancy.

SUMMARY OF THE INVENTION

An aspect of the invention comprises in combination an offshore oil/gas production platform, a submerged connection header for said platform and a quick connect/disconnect system for said platform and said connection header;

i) said platform comprises a vessel, means for ballasting/deballasting the vessel, a connection bay on vessel bottom, production lines extending into said bay and control communication lines extending into said bay;

ii) said connection header comprises an enclosed body, production lines extending through the body and presented on an upper portion of the body, control lines presented on said upper portion of the body, means for positively buoying said body and tension cables extending from the body to ocean floor to retain said buoyed connection header at a desired ocean depth;

iii) the quick connect/disconnect system comprising means for releasably coupling the production lines and control lines in the vessel bay and the upper portion of the header, means for releasably linking the header to the vessel bay whereby the vessel is held in a state of positive buoyancy by the linking means and the tension cables when said deballasting means deballasts the vessel, means for forcing apart the header from said vessel to break the linking means and the coupling means to permit the vessel to move upwardly away from the connection header.

In accordance with a preferred aspect of the invention the service bay on the vessel bottom may be at least partially cleared of water by developing air pressure in the bay at least equal to the water head at that depth of water.

In accordance with another preferred aspect of the invention the connection header comprises a device for ballasting/deballasting the body.

In accordance with another preferred aspect of the invention hydraulic cylinders are actuated remotely to hold vessel and connection header together and alternately to severe the connection links and release the vessel from the connection header.

In accordance with another preferred aspect of the invention the vessel includes a slab ice or pack ice deflecting shield extending from the exterior wall to the centrally located control shaft.

In accordance with another preferred aspect of the invention the vessel includes a compartment below the ice deflecting shield, that will reduce buoyancy fluctuations caused by large waves.

BRIEF DESCRIPTION OF THE DRAWINGS

Preferred embodiments of the invention are shown in the drawings wherein:

FIG. 9 is a section through the vessel bay seated on the connection header.

FIG. 10 is a section through the vessel bay connected to the connection header.

FIGS. 12, 13 and 14 are sections through the connection flanges for the productions lines and their use in connection and disconnection.

FIG. 15 is a perspective view of the quick connect and disconnect coupling for the hydraulic cylinder.

FIG. 16 is a side elevation of the coupler of FIG. 15 in the connected position.

FIG. 17 is a side elevation of the coupler of FIG. 15 in the restrained, but releasable position.

DETAILED DESCRIPTION OF PREFERRED EMBODIMENTS

The disconnectable tension leg production platform is a floating structure restrained by tensile cables anchored to the sea floor and connected to the submerged buoyed connection header. A high level of stability of the platform is obtained by the structure being held in state of positive buoyancy. The production platform is reusable in a multitude of water depths and readily withstands the grazing of significantly sized icebergs without having to disconnect. Pack ice is easily diverted by the ice diverting shield at the water line of the structure. Although floating production, storage and off loading vessels have been contemplated in the past, the system in accordance with this invention is capable of connection and disconnection in a more efficient manner so as to minimize down time in the event of having to cease production and allow an iceberg or storm to pass. The production vessel is capable of storing crude oil and natural gas and liquids while at the same time provide for transfer of these hydrocarbon products to tankers. The production vessel maybe cylindrical in shape negating the requirement for the vessel to weather vane which is common to other types of production vessels which have disconnect capabilities. In order to provide the necessary stability and robust nature for the production vessel it is constructed using post tension reinforced concrete techniques. At the water line elevation of the vessel a suitable ice diverter is provided. Such an ice diverting shield may extend from the outer most wall (submerged), to the central core column (above water line). The ice diverting shield may also be supported by the internal partition walls. Buoyancy fluctuations may be minimized by providing a buoyancy fluctuation compartment which is located directly below the ice diverting shield and is capable of considerably reducing the amplitude of buoyancy oscillations of the vessel.

Figure 1:
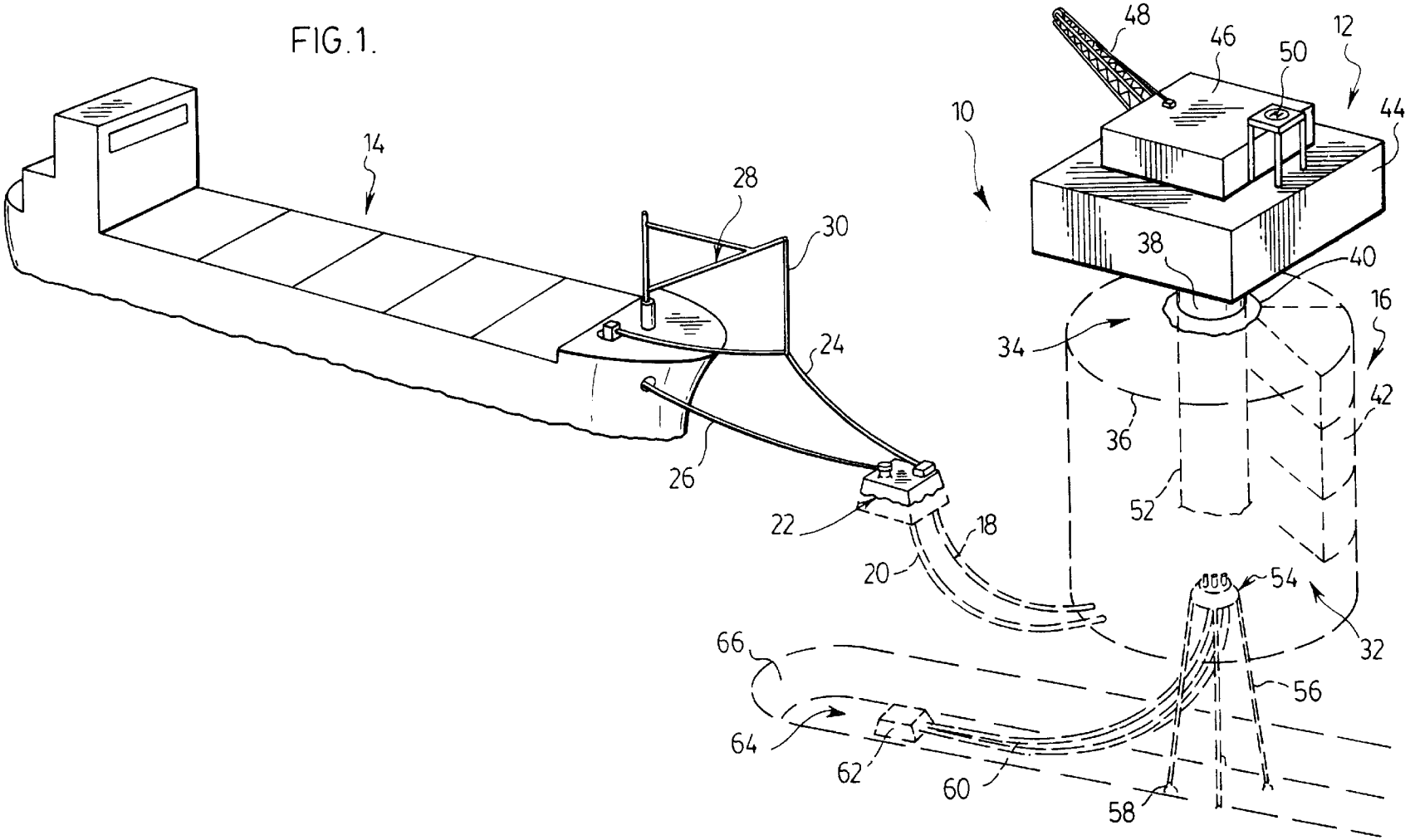
FIG. 1 is a perspective view of the offshore oil and gas production platform in accordance with an aspect of this invention and an oil tanker.

With reference to FIG. 1 the disconnectable tension leg production platform 10 is shown as offloading hydrocarbon products usually crude oil and/or natural gas to a tanker 14. The production facility 10 has topsides platform 12 and a vessel 16. The vessel 16 is capable of offloading stored hydrocarbons through line 18 to a mooring buoy 22. The mooring buoy is restrained by mooring line 20 and transfers the hydrocarbon products to the tanker 14 through umbilical transfer line 24 while the tanker is secured to the mooring buoy 22 by way of mooring line 26. If desired to maintain the transfer line 24 above water level the usual crane 28 may be used to support the line 24 by cable 30. The production vessel 16 is preferably cylindrical in shape although it is understood that it may take on various other shapes depending upon its end use. The preferred cylindrical shape avoids having to compensate for weather vaning of the vessel during offshore use. The vessel 16 may be constructed using post tension reinforced concrete techniques to ensure that the walls 32 of the vessel have sufficient strength to resist thermal induced stresses and collisions with smaller objects such as small icebergs and the like. The vessel 16 has a pack ice deflection shield 34 which extends from the perimeter 36, positioned below the operating waterline of the cylindrical portion of the vessel upwardly to the central core column 38 above the water line 40 when the vessel is in the production position. The vessel 16 may include a plurality of chambers shown in dot at 42 to contain hydrocarbon products such as crude oil and natural gas. In its well designated compartments it may contain ocean water or air as needed to either ballast or deballast the vessel.

Figure 1A:
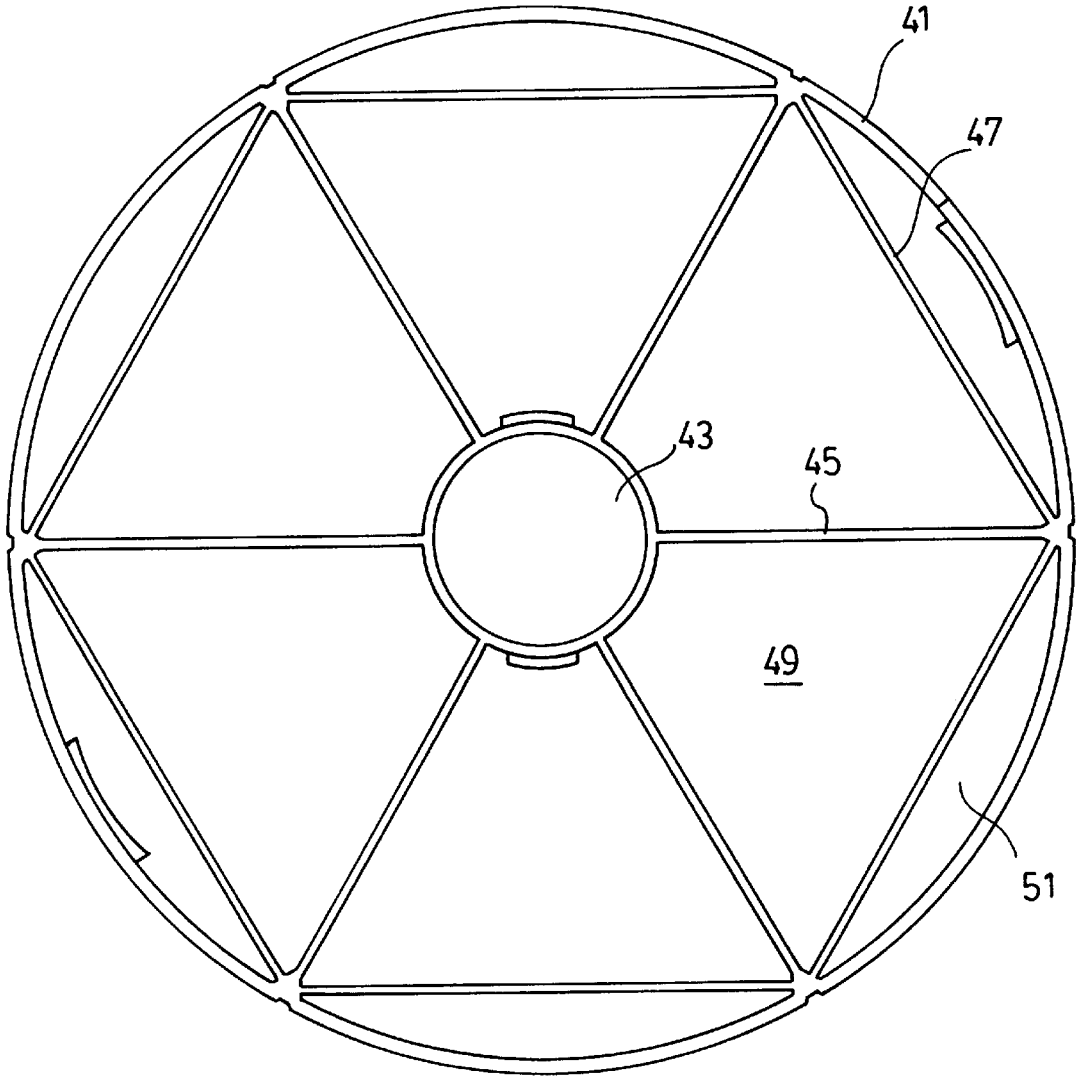
FIG. 1A is a section through the vessel.

The production vessel would be generally cylindrical in shape, as shown in FIG. 1A, with a strong external wall 41 tied to an inner core 43 by internal partition walls 45. To provide additional structural strength and isolation protection, a segregation wall 47 is incorporated. The area 49 between the inner core and the segregation wall, may be used for hydrocarbon storage and low pressure separation. In the upper portion of this area, production equipment may be installed, reducing the weight of the topside 12. The area 51 between the external wall and the segregation wall may be used for ballast.

The platform 12 houses the usual accommodations and production equipment in the topsides structure 44 along with the usual production facility cranes 48 and helicopter pad 50. The inner column 38 may extend through the vessel in dot at 52 which can provide a service corridor downwardly to the submerged connection header generally designated 54. The submerged connection header is buoyed and held in place by tension cables 56 secured to the sea bed by anchors 58. The anchors 58 arc in turn embedded in the sea bed where there are sufficient number of cables and anchors to withstand within design tolerances the upward forces applied on a connection header by wave induced buoyancy and the positive state of buoyancy of the vessel 16. The connection header 54 has flexible production lines and communication lines 60 extending downwardly to the seabed wellhead module 62. The wellhead module 62 may be protected from iceberg scour by installing it in an excavated hole 64, which is commonly referred to as a glory hole. In accordance with this particular embodiment of the invention a glory hole 64 is defined by a trench having sloped sides 66. The advantage of the trench will be discussed in respect of the subsequent Figures to accommodate mammoth icebergs encroaching on the production facility.

It is understood that with this arrangement several offloading mooring buoys 22 may be provided about the perimeter of the vessel 16 to always allow positioning of the tanker 14 down wind or down current of the vessel. It is also understood that the lines 20 and 26 are all positioned and can withstand the necessary tension forces in maintaining the shuttle tanker 14 in position and provide a secure mooring for the tanker.

The vessel 16 may be equipped with suitable pumps for either adding ballast to selected tanks 42 in the vessel or evacuating the tanks at 42. This usual ballasting and deballasting of the vessel is carried out for purposes of floating the vessel so that it may be towed to the production site, lowering the vessel so that it may be interconnected to the connection header and placing the vessel under positive buoyancy when connected to the connection header to simultaneously achieve a stable structure in an ocean environment and at the same time provide for quick disconnect in the event of a hazard, such as an iceberg or other potential hazard.

Figure 2:
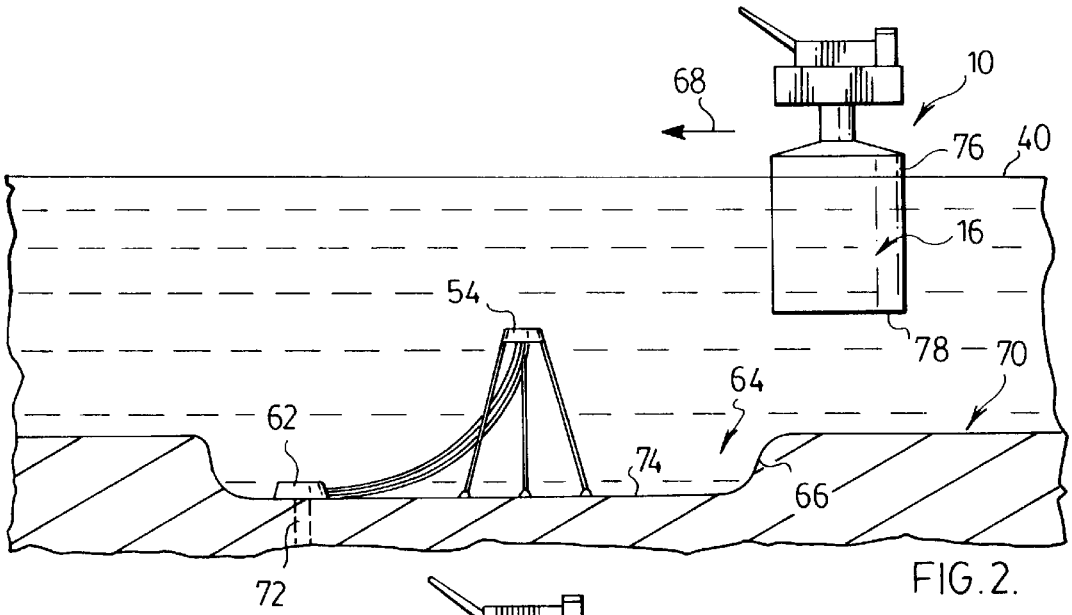
FIGS. 2, 3 and 4 are representative sketches of sequence of events in locating the production platform on the connection header.
Figure 3:
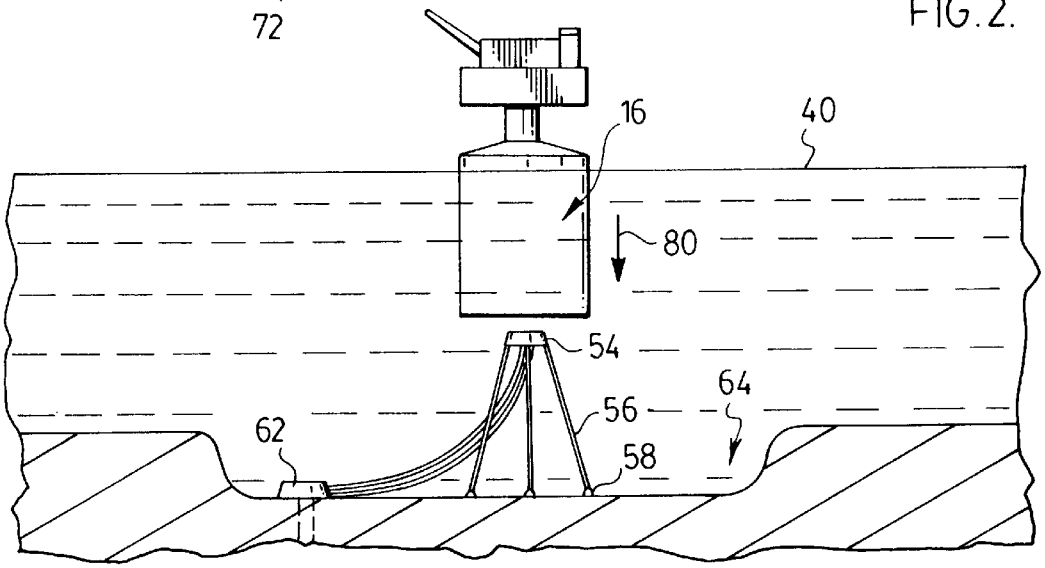

The connection and disconnection of the production platform 10 to the positively buoyed connection header is discussed in respect of the sequence of events shown in FIGS. 2 through 7. As shown in FIG. 2 the production facility 10 may be towed or propelled in the direction of arrow 68 towards the submerged connection header 54. The ocean sea bed 70 has been prepared with a trench 64 to a depth as indicated by the sidewall 66 to accommodate at least the height of the connection header 54 should it be ballasted to drop within the trench 64. The well head module 62 is secured to the production pipe 72 in the base of the trench 74. The vessel 16 is ballasted so that a portion of the vessel 76 is above the water line 40 and the base of the vessel 78 clears the connection header 54. When the vessel is in place as shown in FIG. 3 the ballasting mechanism is actuated to load the ballast chambers of the vessel 16 with ocean water so that the production vessel submerges further in the direction of arrow 80 towards the connection header 54. During this phase the connection header 54 is positively buoyed and restrained in position by the tension cables 56. As the vessel approaches the connection header 54 the underside of the vessel 16 includes a connection bay to be described in more detail with respect to FIG. 8 which includes the necessary equipment for connection to the connection header 54. When the connection is complete the vessel 16 is in the position shown in FIG. 4 where the water line 40 on the ice diverting shield 34 is positioned to divert pack ice. The vessel 16 may then be placed in a state of positive buoyancy due to its interconnection to the connection header 54 which is restrained in position by the tension cables 56.

Figure 5:
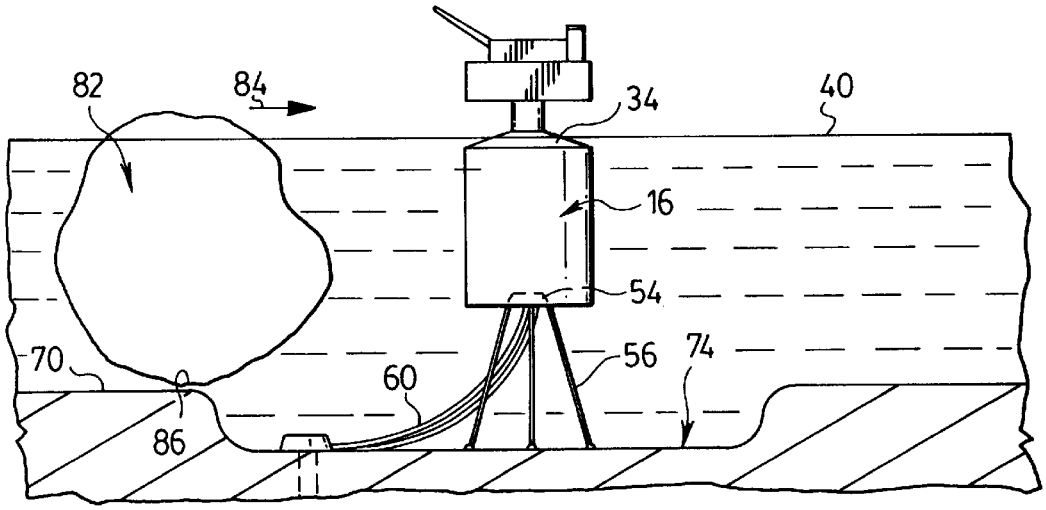
FIGS. 5, 6 and 7 are schematics showing a sequence of events in providing for quick disconnect of the production platform from the connection header to avoid an iceberg.

If an approaching iceberg is sufficiently small, a disconnection may not be necessary as it may simply bump into and pass by the production vessel 16, where there is sufficient play in the productions lines 60 to permit the vessel to cant slightly as permitted by the tension cables 56. In the event of an approaching hazard such as a mammoth iceberg 82 as shown in FIG. 5 which is approaching the production vessel 16 in the direction of arrow 84, the vessel would disconnect and be permitted to move away from the approaching iceberg 82. With the approach of an iceberg 82 where its base 86 is scrapping the seabed floor 70, it is necessary to move the production vessel 16 out of the way of the iceberg 82. In view of the quick disconnect of the vessel 16 from the connection header 54 a "last minute" decision can be made as to whether or not to disconnect in view of the chanting currents and wind directions in the ocean. It is therefor possible that the iceberg path may change and avoid the production vessel hence the quick disconnect feature of this invention optimizes production efficiency in avoiding having to disconnect and shut down production unnecessarily in advance of the approach of the iceberg. As will be discussed with respect to the subsequent Figures the vessel 16 may be quickly disconnected from the connection header 54, the vessel 16 being under positive buoyancy. Once the separation is achieved between the vessel 16 and the connection header 54, the vessel 16 immediately rises in the direction of arrow 88. The extent of rise may be to that shown in FIG. 6 in the direction of arrow 88 or the extent of rise may be sufficient to simply clear the base 78 of the vessel from the connection header 54. The vessel 16 may then be floated or towed from the iceberg 82. At this stage the platform may even withstand the grazing of the mammoth iceberg without damaging the vessel.

Figure 4:
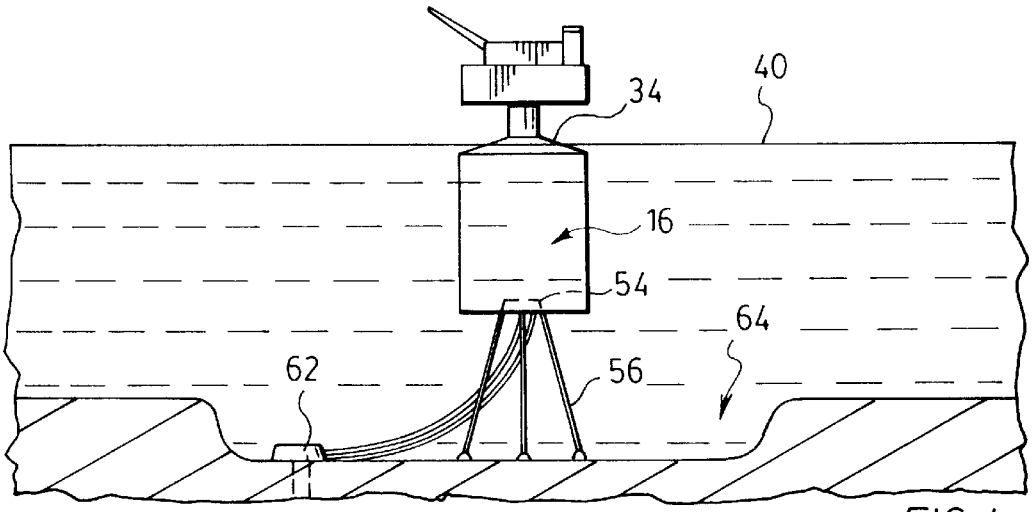

In accordance with an aspect of this invention the positioning of the well head module 62 and the anchors 58 for the connection header cables 56 may be provided in the trench 64. This features allows one to clear the connection header 54 away from the iceberg 82 so that its base portion 86 does not damage the connection header and productions lines 60. In order to drop the connection header 54 out of the path of the iceberg 82 the connection header 54 is equipped with a remotely controlled ballast/deballast system. When there is a desire to drop the connection header 54 into the trench 64, the natural stiffness of the flexible production lines 60, directs the connection header 54 and flexible production lines 60 into the trench 64. In this position the iceberg 82 as it traverses the area in the direction of arrow 84 does not damage the production manifold 62, flexible production lines 60, or the connection header 54 because the base portion 86 of the iceberg which is grinding along the sea bed floor 70 does not drop far enough into the trench 64 to cause any damage to the laid down equipment. The production vessel 16 continues in a direction 92 away from the iceberg 82 until is passes. After it has passed the production area the production vessel 16 moves back into position overtop of the production area. At the same time the connection header 54 with the remotely actuable ballast system is then actuated to provide a positive buoyancy in the connection header 54 so it moves upwardly to its normal position as shown in FIG. 4.

Figure 8:
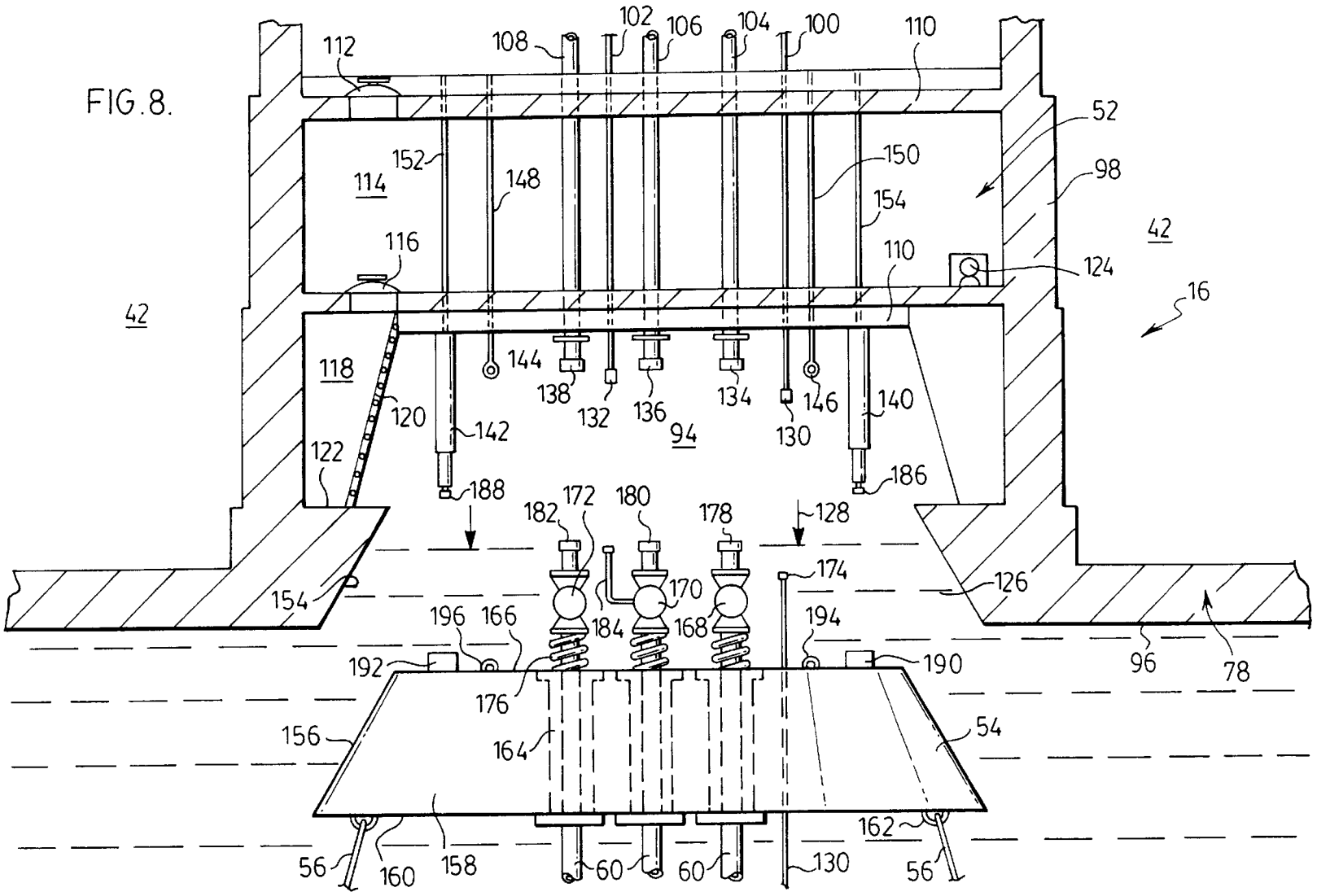
FIG. 8 is a section through the vessel bay and approaching connection header.

The procedure in connecting the vessel 16 to the connection header 54 shall be described with respect to FIGS. 8 through 10. In FIG. 8 the bottom portion 78 of the vessel 16 has a connection bay 94 provided on the vessel underside 96. The connection bay 94 is located centrally of the vessel 16 and in line with the service shaft 52. A portion of the storage tanks 97 are shown on the extremity of the walls 98 for the service corridor 52. The service corridor contains mechanical and communication control lines 100 and 102 as well as production lines 104, 106 and 108. The central corridor may also include several bulkheads 110 which partition off the corridor and control flooding in the event of a rupture in one of the bulkheads. Each bulkhead 110 includes the usual access port 112 which allows personnel to move from one service area 52 down to the next. Access to the connection bay 94 is through pressure equalization/decompression chamber 114 and on through hatch 116 which opens into space 118. A ladder 120 allows service personnel to reach the floor area 122 of the connection bay 94. Suitable pumps are provided for each service bay area 52 or 114 between the bulkheads 110 to evacuate any sea water which may penetrate the respective service area and this way flooding of the service corridor is avoided and safety for the personnel is maintained at all times.

In accordance with a preferred embodiment of the invention the vessel connection bay 94 may be pressurized with oxygen depleted air. Air is fed into the bay 94 where an air pressure is developed at least equal to the pressure of the water head 126 at this depth in the ocean to force the water out of the bay in the direction of arrows 128. This step provides a water-free environment within the bay 94 to allow personnel to move about in area 94 in completing the connections of the vessel 16 to the connection header 54. It is understood of course that the personnel who complete the connection in area 94 may do so with some water in the bay. As a safety precaution, work persons would be equipped with deep-sea diving dry-suits complete with air supply lines.

Within the bay 94 are the terminal ends 130 and 132 for the mechanical communication lines 100 and 102 and 134, 136 and 138 for the production lines 104, 106 and 108. In addition, in the bay 94 arc hydraulic rams 140 and 142 which are used in the connection and disconnection process as well as connection ends 144 and 146 which are anchored by anchor rods 148 and 150. The anchor rods 148 and 150 arc anchored to internal partition walls continued through the core column to an elevation above the pressure equalization chamber 114. Hydraulic fluid is fed to the hydraulic rams 140 and 142 through hydraulic lines 152 and 154. The hydraulic rams 140 and 142 are also anchored similar to the connection ends 144 and 146.

The vessel 16 is slowly ballasted so that the connection bay 94 slowly moves onto the connection header 54. The connection bay 94 in accordance with a preferred embodiment includes a sloped surface 154 which mates with the sloped surface 156 on the header 54. The mating, sloped surfaces 154 and 156 assist in the alignment of the connection bay 94 onto the connection header 54.

The connection header 54 has a body portion 158 which has attached to its lower portion 160 the restraining tension cables 56. The tension cables 56 are connected to the lower portion 160 by cable couplers 162. The production lines 60 extend through the body portion 158 via open sleeves 164. Similarly the communication cable 130 extends through the body portion 158. The upper surface 166 carries Emergency shut down valves (ESDV's) 168, 170 and 172 for the production of hydrocarbons. In addition mechanical line 130 is equipped with a quick connection coupling 174. The valves 168, 170 and 172 are spring loaded with a spring system 176 to resiliently urge the couplings 178, 180 and 182 towards the respective couplings 134, 136 and 138 of the production lines 104, 106 and 108 in the vessel 16. The spring system 176 ensures a secure seal of the connections of the ESDV's 168, 170, & 172 to the production lines 104, 106, & 108 should there be relative movement of the vessel bay 94 to the connection header 54 after connection is made.

Each ESDV 168, 170 and 172 is controlled by a hydraulic or pneumatic means well known in the oil and gas industry. Mechanical line 132 is connected to line 184 to control the opening and closing of the ESDV's 168, 170 and 172. After a secure connection is made the valves would be opened to provide for production and when it is desired to make a quick disconnect the valve would be closed just prior to the disconnect.

As the vessel bay 94 approaches the connection header 54 the releasable connectors 186 and 188 of the rams are connected to the header stubs 190 and 192 on the upper surface 166 of the connection header 54. In addition the connection header carries on its upper surface 166 connectors 194 and 196 which will be coupled to the respective connectors 144 and 146 in a manner to be described with respect to FIG. 10.

As shown in FIG. 9 the vessel 16 has its vessel bay 94 seated on the connection header 54. The hydraulic rams 140 and 142 are coupled to the header stubs 190 and 192. The rams 140 and 142 are retracted so as to snug up the connection of the header 54 to the vessel 16. Workmen then attend to the connection of line couplings 134, 136 and 138 with production line couplings 178, 180 and 182 in a manner to be described with respect to FIGS. 12 and 13. In addition the mechanical lines 132 and 184 are connected as well as communication lines 100 and 174.

At this stage the vessel 16 is deballasted to the extent to provide a desired degree of positive buoyancy in the vessel 16. The vessel position is retained however due to the interconnection of the vessel to the connection header 54 which in turn is restrained in its position by way of tension cables 56. It is understood that the tension cables 56 are capable of holding the vessel in place even during high seas when strong lateral and buoyant forces are exerted on the vessel. In addition, it is understood that the separable links 198 and 200 are also of sufficient strength to restrain the vessel in place even under positive buoyancy.

The couplings 202, 204 and 206 for the respective coupling portions 134, 136, 138, 180 and 182 are shown in more detail in FIGS. 12 and 13. For example coupling portions 134 and 178 are moved in a relative manner towards each other as indicated by arrows 208. Each coupling portion includes a flange 210 and 212 to complete connection to the respective productions lines. Each coupling also has abutting rims 214 and 216 which have sealable interfaces 218 and 220. Once the faces 218 and 220 are brought together by virtue of the vessel bay 94 being seated and secured on the production header 54 a collar 222 is applied to the rims 214 and 216. The collar has flanges 224 and 226 which engage the undercut shoulders 228 and 230 on the respective rims 214 and 216 to couple the members 134 and 178 to allow production to begin and provide an open bore between line 60 and line 104 through communicating bore 232. The collar is designed to break at a specified stress induced when members 134 and 178 are being forced apart by the disconnect means.

Figure 6:
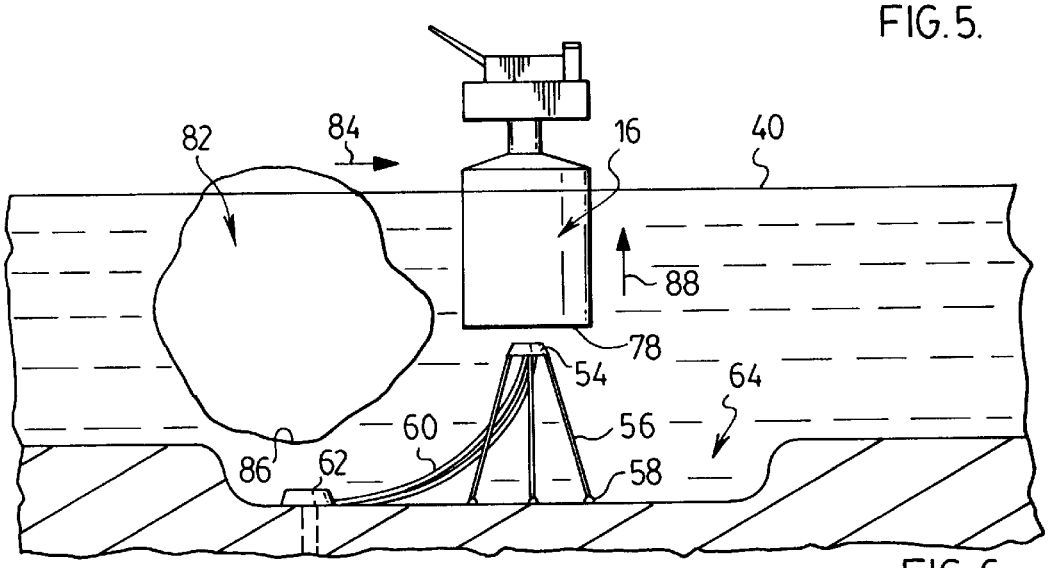
Figure 7:
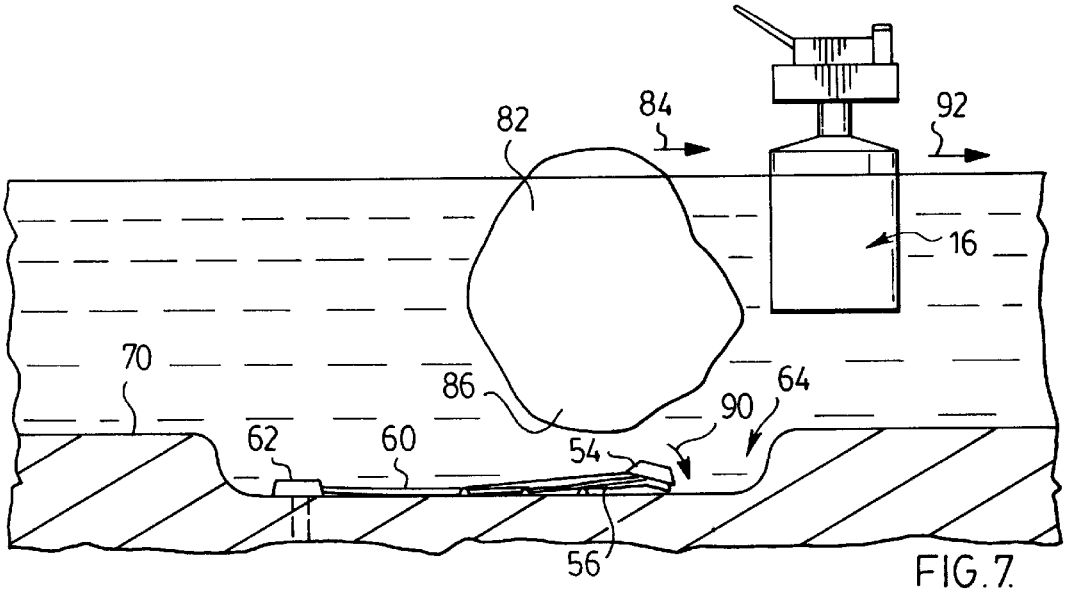
Figure 11:
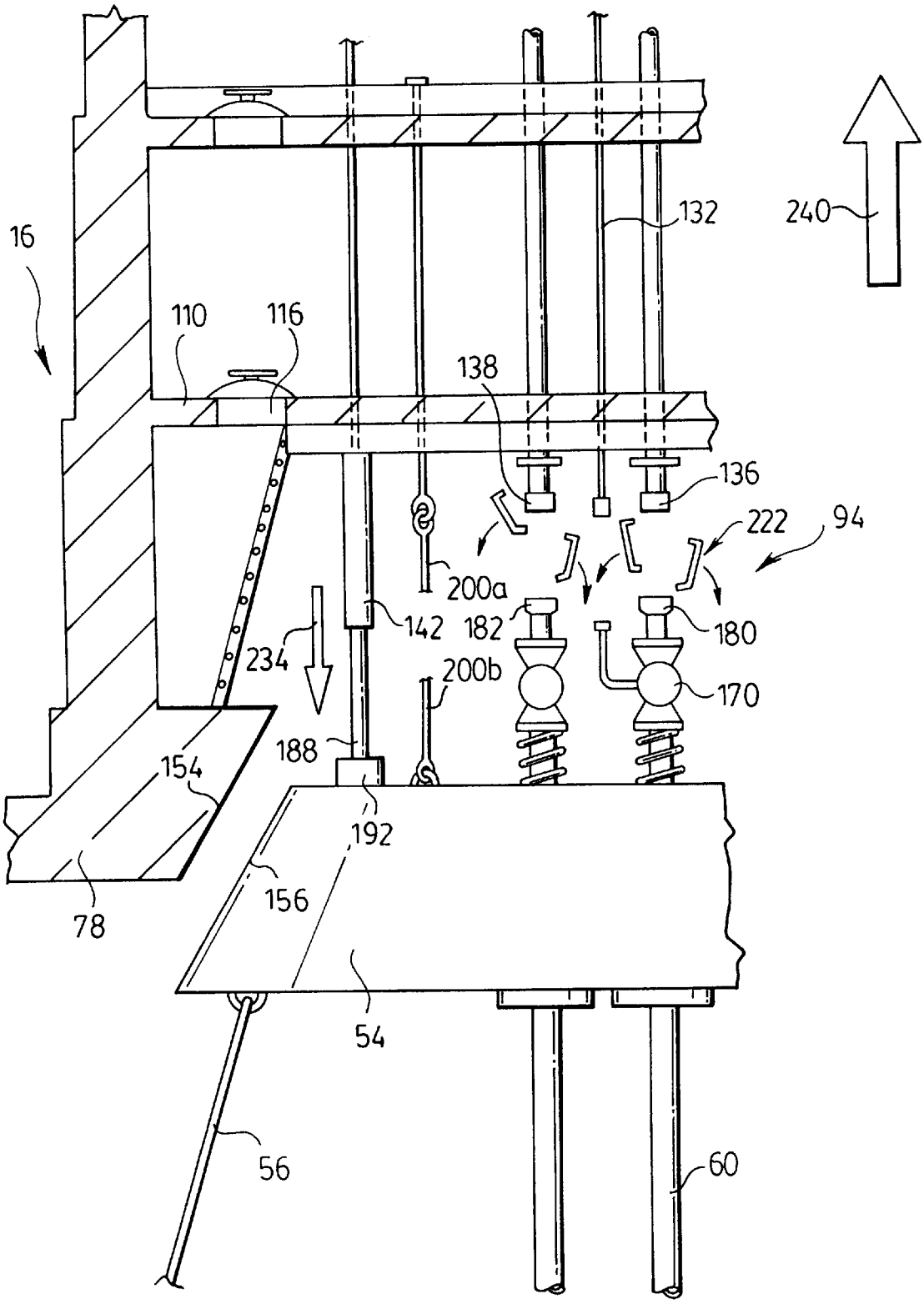
FIG. 11 is a partial section through the vessel bay showing disconnect from the connection header.

In the event of an emergency quick disconnect as required, for example, in respect of the sequence of events in FIGS. 5 through 7 the vessel 16 can be quickly pushed away from the connection header 54 in manner to be discussed with respect to FIG. 11. The hydraulic rams 140 and 142 are instrumental in a quick disconnect. The links 198 and 200 can be separated at a tension value greater than the tensions under which the fusible links normally operate in maintaining the positively buoyed vessel 16 connected to the connection header 54. As shown in FIG. 11 the hydraulic cylinder 142 is extended as indicated by arrow 234 to push the connection bay 94 away from the connection header 54 and thereby separate the surfaces 154 and 156 respectively of the vessel bottom 78 and of the connection header 54. The separation force exerted by the hydraulic cylinders combined with the upwardly acting buoyant force is sufficient to overcome the maximum tension of the separable links 198 and 200. As an example link 200 separates as shown into link portions 200*a* and 200*b*. In coordination with the separation of the links 198 and 200, the collars 222 are broken away to allow the coupling members of the production lines to separate such as 136 from 180 and 138 from 182. Also coordinated with this event are the closure of ESDV's through the respective mechanical lines. Even if the closure of the ESDV's is not complete by the remote mechanical means, closure would be completed by a fail-close system (common place in the oil and gas industry). As shown in FIG. 14 by the hydraulic cylinder initiating the separation of the vessel bay from the connection header in the direction of arrow 236, the respective collar 222 is busted apart as indicated by arrows 238 to allow thereby the respective coupling 134 to separate from production line coupling 178. In this manner a quick disconnect of the production lines is made due to the vessel 16 being under positive buoyancy. As soon as the separable links are broken the vessel will immediately float upwardly away from the connection header 54 and the respective end of the ram connector 188 separates from the respective header stub 192 of the connection header. The vessel will then rise in the direction of arrow 240 to the extent determined by the degree of positive buoyancy in the vessel. This may be to the extent as shown in FIG. 5 where the vessel sidewalls rise slightly above the water level 40 at which point the vessel may be either self propelled or allowed to float or towed out of harms way of the approaching iceberg 82.

As shown in FIG. 15 the operative end 188, for example, of the hydraulic ram 142, is shown. The upper surface 166 of the submerged connection header includes header stubs generally designated 192. When the operative end 188 approaches the header stub 192 the system is capable of grabbing the header stub 192 for purposes of drawing the vessel towards the connection header and is also capable of quickly releasing from the header stub 192. The operative end 188 includes hinged clamp elements 242 which are hinged at 244 to the stem 246 of the operative end 188. Above the hinged clamp elements 242 is a collar 248 which is held in position by pivotal wings 250 which are pivoted at 252 to the stem portion 246. As the operative end 188 approaches the header stub 192 the wings 242 are wedged outwardly as they engage the sloped surface 254 of the stub member 256. As they pass over the enlarged stub portion 256 they fall under the inwardly sloped portion 258 of the base 260 which is connected to the top portion 166 of the submerged connection header. As shown in FIG. 16 the wings 250 may be manually or automatically moved to the outer position 250*a* to release the collar 248. With the collar about the clamp segments 242 a secure connection is made between the operative end 188 of the hydraulic cylinder and the header stub 192. This is due to the clamp segments 242 including abutment portions 262 which engage the inwardly sloping undercut surface 258 of the stub 256. With the wings 250 in the elevated position, the collar 248 maintains engagement of the clamp about the stub so that the hydraulic cylinder when retracted in the direction of arrow 264 draws the connection header towards the vessel bay. As the hydraulic ram nears the fully retracted position, the wings 250 are wedged out to clamp onto the collar 248. When it is desired to release and push the vessel away from the connection header and break the severable links in the manner discussed with respect to FIG. 11, the ram portion 245 of the hydraulic cylinder 246 is expelled downwardly. As the ram is extended in the direction of arrow 268 the collar 248 is retained in position by wing clamps 250. At this stage the severable links 200 and the production line coupling members 222 are broken which allows the vessel 16 to move upwardly away from the connection header 54. As the vessel 16 rises the clamp segments 242 are then allowed to hinge outwardly because the collar 248 no longer restrains them. The clamp segments release engagement with the header stub 192 so that the vessel may continue to move upwardly away from the connection header in the manner discussed with respect to FIG. 11. This arrangement therefore provides a reliable mechanically functional type of connection for the ram to the connection header to facilitate connection and remote disconnection.

In accordance with this invention a disconnectable tension leg production platform is provided which has many significant advantages and features over the prior art systems. Unlike the gravity based structures, the production platform of this invention may be readily coupled to the production lines and then subsequently removed quickly. It is therefore mobile. It is also less expensive to build. The production platform is also superior to the floating production storage and off-loading vessels which weathervane relative to oncoming winds and currents and must be equipped with a dynamic positioning system to minimize stresses on the two-part turret system. The positive buoyancy of the production vessel after it is connected to the connection header greatly enhances the stability of the structure particularly during heavy wave action.

Figure 18:
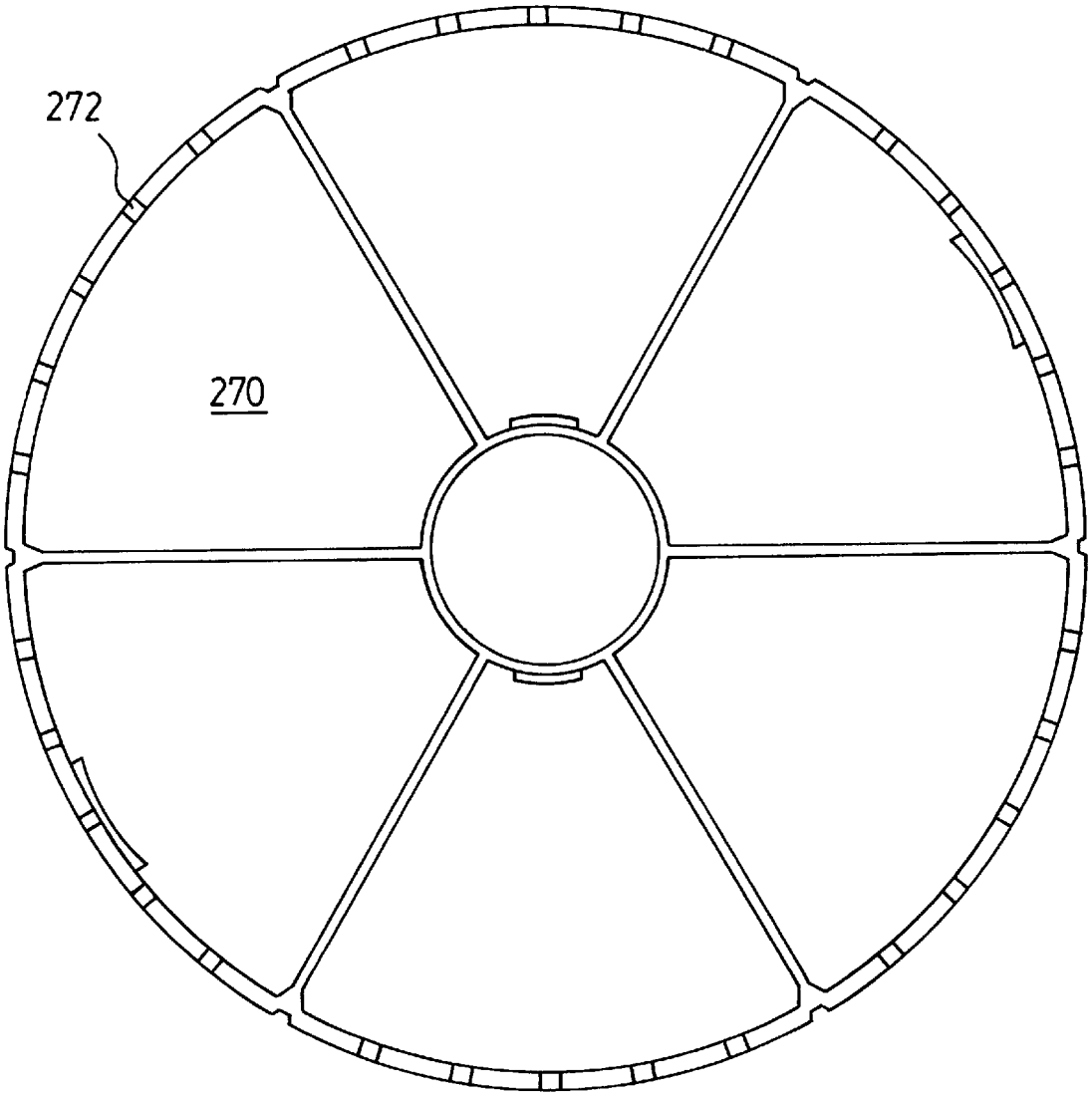
FIG. 18 is a section through the vessel upper portion showing the wave surge compartments.

In order to minimize movement in heavy wave action the production vessel may include below the ice diverter shield, a series of buoyancy fluctuation chambers. Such chambers 270 as shown in section in FIG. 18 would allow water to passively flow out through one way flapper type gates 272 during the wave-valley state of a passing wave. As the wave elevation increases, these flapper gates 272 would swing shut under the water head differential, keeping additional water from entering the chambers. The system would be designed and adjustable so that, at the point of the wave crest, the net differentials in overburden and buoyancy would be roughly matched. Thus, the tension lines 56 would experience little variation in tension.

The chambers 270 serve another purpose. In normal waters the buoyancy differences experienced by the vessel 16 are incrementally small because the net displacement is related to the diameter of the vessel core and not the outer wall. Thus, the vessel 16 can be restrained in a state of positive buoyancy using considerably less tension in the tension lines 56, without risking negative buoyancy caused by a wave valley. The top horizontal deck of the vessel 16 would also be the bottom of the buoyancy fluctuation chamber. The elevation of this deck would correspond to the maximum design wave valley depth. Thus, the platform 10 may be kept in a state of positive buoyancy, with relatively little tension on the tension lines 56.

The concept of using a device to push the vessel away from the connection header and rely on the positive buoyancy of the vessel to effect quick separation is very effective and allows for last minute decision making in moving away from the production lines. This is particularly facilitated in the use of couplings for the production lines and the mechanical communications control lines which readily break apart and the separable links which are designed to break when a tension is exerted on them in excess of the normal operating tensions. To achieve this separation hydraulic rams are used which are capable of developing these types of separation forces. It is appreciated that a plurality of separable link arms may be used to provide the necessary restraining tension and at the same time a plurality of rams may also be used.

Although preferred embodiments of the invention have been described herein in detail, it will be understood by those skilled in the art that variations may be made thereto without departing from the spirit of the invention or the scope of the appended claims.

I claim:

1. In combination, an offshore oil/gas production platform, a submerged connection header for said platform and a quick connect/disconnect system for said platform and said connection header;

i) said platform comprising a vessel, at least one production deck provided on said vessel, means for ballasting/deballasting said vessel, a connection bay on the bottom of said vessel, production lines extending into said bay and control lines extending into said bay;

ii) said connection header comprising an enclosed body, production lines extending through said body and presented on an upper portion of said body, control lines presented on said upper portion of said body, means for ballasting/deballasting said body and tension cables extending from said body to ocean floor to retain said debalasted connection header at a desired ocean depth;

iii) said quick connect/disconnect system comprising means for releaseably coupling said control lines and production lines in said vessel connection bay and said upper portion of said header, means for releaseably linking said header to said vessel bay whereby said vessel is held in a state of positive buoyancy by said linking means and said tension cables when said deballasting means deballasts said vessel, means for forcing apart said header from said vessel to break said linking means and said coupling means to permit said vessel to move away from said connection header.

2. The combination of claim 1 wherein said vessel additionally comprises means for developing air pressure in said vessel connection bay at least equal to head of water at depth of said submerged connection header to at least partially evacuate water from said bay.

3. The combination of claim 1 wherein above said bay exists an equalization/depressurization chamber to enter and exit into said pressurized bay.

4. The combination of claim 1 wherein said complementary surfaces are conical.

5. The combination of claim 4 wherein said means for forcing apart said vessel and header comprises a plurality of hydraulic cylinders which are capable of developing separation forces for exceeding said predetermined tension in said engineered portions.

6. The combination of claim 1 wherein said tension cables extend from a lower portion of said body, said upper portion of said body and a lower portion of said vessel bay having complementary surfaces to guide docking of said vessel on said header.

7. The combination of claim 1 wherein said linking means comprises a plurality of link rods or cables and means for interconnecting rod or cable ends to said vessel bay and an upper surface of said connection header, said rods or cables each having an engineered portion which separates at a predetermined tension.

8. The combination of claim 7 wherein said hydraulic cylinders have one end connected to said vessel connection bay and said connection header having means for releasable connection to the other end of said cylinders, said means for releasable connection of each said cylinder releasing said cylinder end from said header when said cylinders separate said engineered portions and push said vessel away from said connection header, said means for releasable connection of each said cylinder coupling said cylinder ends with said connection header when said cylinders draw said vessel bay towards said connection header.

9. The combination of claim 8 wherein said production lines in said header include remotely controlled shut off valves.

10. The combination of claim 9 wherein said deballasting means is remotely actuated.

11. The combination of claim 10 wherein said vessel comprises buoyancy fluctuation compartments below an ice diverter shield to reduce cyclic loading on tension cables for said connection header.

12. The combination of claim 7 wherein said coupling means for said production lines and control lines separate during said hydraulic cylinders forcing said vessel and connection header apart.

13. The combination of claim 1 wherein said tension cables for said connection header are embedded in a trench in seabed floor, said connection header with tension cables sinking into said trench when said ballasting means ballasts said header and said header is separated from said vessel bay.

14. The combination of claim 1 wherein said vessel is an upright structure having a continuous exterior wall extending from vessel bottom to above water line, a platform being mounted on top of said vessel, a central shaft extending from said platform into said vessel, said vessel having a slab ice or packed ice deflecting shield extending from said exterior wall to said control shaft.

* * * * *